US007038391B2

(12) United States Patent
Tsumura

(10) Patent No.: US 7,038,391 B2
(45) **Date of Patent: *May 2, 2006**

(54) BACKLIGHT DEVICE AND A BACKLIGHTING ELEMENT

(75) Inventor: Toshiyuki Tsumura, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/464,218

(22) Filed: Jun. 18, 2003

(65) Prior Publication Data

US 2003/0209991 A1 Nov. 13, 2003

Related U.S. Application Data

(62) Division of application No. 09/849,789, filed on May 4, 2001, now Pat. No. 6,583,579, which is a division of application No. 09/363,724, filed on Jul. 29, 1999, now Pat. No. 6,255,781.

(30) Foreign Application Priority Data

Aug. 26, 1998 (JP) ..... 10-240512

(51) Int. Cl.
*G09G 3/00* (2006.01)

(52) U.S. Cl. ..... 315/169.1; 315/169.3; 345/76

(58) Field of Classification Search ..... 315/169.1, 315/169.3, 225, 136, 132
See application file for complete search history.

(56) References Cited

U.S. PATENT DOCUMENTS 5,283,563 A * 2/1994 Allen et al. ..... 349/77
5,384,577 A 1/1995 McLaughlin et al. ..... 345/102
5,440,208 A * 8/1995 Uskali et al. ..... 315/169.3
5,468,064 A * 11/1995 Lengyel et al. ..... 349/96
6,100,952 A * 8/2000 Marvin et al. ..... 349/62
6,210,012 B1 * 4/2001 Broer ..... 362/84
6,255,781 B1 * 7/2001 Tsumura ..... 315/169.1
6,335,773 B1 * 1/2002 Kamei et al. ..... 349/96
6,411,353 B1 * 6/2002 Yarita et al. ..... 349/59
6,504,589 B1 * 1/2003 Kashima et al. ..... 349/96

FOREIGN PATENT DOCUMENTS

| | | |
|---|---|---|
| JP | 52-89096 | 7/1977 |
| JP | 54-079677 | 6/1979 |
| JP | 56-39628 | 4/1981 |
| JP | 56-94020 | 7/1981 |
| JP | 59-97191 | 6/1984 |
| JP | 61-11786 | 1/1986 |
| JP | 62-125389 | 6/1987 |
| JP | 2-19827 | 1/1990 |
| JP | 2-33930 | 3/1990 |

(Continued)

*Primary Examiner*—David Vu
(74) *Attorney, Agent, or Firm*—Pearne & Gordon LLP

(57) ABSTRACT

A backlighting element 13 includes an EL panel for illuminating the back of a display unit 11, to thereby provide a good viewing. A control unit 16 sends an instruction to a backlight driver 14, and intermittently drives the backlighting element 13 at appropriate timings, or temporarily stops the driving of the backlighting element 13 in synchronism with operation timings of a radio processing unit 17. The radio processing unit is adversely affected by noise generated when the backlighting element is operated. A light storage member is provided on the backlighting element 13 or in its vicinity. With provision of the light storage member, the lighting time of the backlighting element is reduced. When the backlighting element is lit off, the user is not put to inconvenience.

11 Claims, 5 Drawing Sheets

FOREIGN PATENT DOCUMENTS

| | | |
|---|---|---|
| JP | 3-20581 | 2/1991 |
| JP | 3-46789 | 2/1991 |
| JP | 05-127626 | 5/1993 |
| JP | 5-165411 | 7/1993 |
| JP | 07/191298 | 7/1995 |
| JP | 07-281150 | 10/1995 |
| JP | 07-281647 | 10/1995 |
| JP | 07-301798 | 11/1995 |
| JP | 9-93324 | 4/1997 |
| JP | 9-102392 | 4/1997 |
| JP | 10-23129 | 1/1998 |
| JP | 10-145476 | 5/1998 |
| JP | 10/154409 | 6/1998 |
| JP | 10-164188 | 6/1998 |
| JP | 10-200426 | 7/1998 |

* cited by examiner

PRIOR ART

BACKLIGHT DEVICE AND A BACKLIGHTING ELEMENT

This application is a divisional of U.S. patent application Ser. No. 09/849,789 filed on May 4, 2001, now U.S. Pat. No. 6,583,579 issued on Jun. 24, 2003, which is a divisional application of U.S. patent application Ser. No. 09/363,724 filed on Jul. 29, 1999, now U.S. Pat. No. 6,255,781 issued on Jul. 3, 2001.

BACKGROUND OF THE INVENTION

The present invention relates to a backlight for illuminating a display section including a liquid crystal display element and an operation section including button switches. More particularly, the invention relates to a backlight device and a backlighting element, which are constructed with an EL panel, LEDs, lamps and others.

There is known a device equipped with a liquid crystal display panel (referred to as an LCD panel) having a liquid crystal display element (LCD) and an operation panel including panel switches associated with operation buttons. Recently, this type of device has been equipped with a backlighting function to illuminate the reverse side of the display section and the operation section in order to render display characters and characters on switches to be legible even in a dark place. In this type of communication device, those characters must be legible in every use condition. Therefore, the backlighting function is indispensable in particular for mobile communication devices, such as portable phones and pagers.

An electrical arrangement of a device with a conventional backlight device is shown in FIG. 12. As shown, the device is made up of a display unit 101, a backlighting element 102, a backlight driver 103, a control unit 104, a switch 105, and a power supply 106. The display unit 101 includes a LCD for displaying characters, for example. The backlighting element 102 includes an EL (electroluminescence) panel for illuminating the back of the display unit 101. The backlight driver 103 drives and controls the backlighting element 102. The control unit 104 controls the display unit 101 and the backlight driver 103. The switch 105 is provided for backlighting. The power supply 106 is used for supplying electric power to the whole device.

FIGS. 13 and 14 cooperate to show a structural arrangement including a display unit and a backlighting element. FIG. 13 shows a side view of a structure including the display unit and the backlighting element. FIG. 14 shows a plan view of the backlighting element. An LCD panel 101*a* forms a display unit 101. An EL panel 102*a* forms a backlighting element 102. The EL panel 102*a* is disposed on the rear side of the LCD panel 101*a*. Light emitted from the EL panel 102*a* passes through the LCD panel 101*a*, and is irradiated from the front broad side thereof. Thus, a structure in which a light is irradiated from the back of the LCD panel 101*a* is employed. A light emitting section 107 is formed in the EL panel 102*a*, while covering the entire viewing area of the LCD panel 101*a*.

Characters and/or images are displayed in the display unit 101 under control by the control unit 104. In this case, the backlighting element 102 is lit in order to secure a satisfactory viewing in a dark place. To light the backlighting element 102, the switch 105 is operated. In response to this, the control unit 104 sends an operation instruction to the backlight driver 103. In turn the backlight driver 103 applies a drive signal having an AC waveform (e.g., a sinusoidal waveform, a triangle waveform, or a rectangular waveform) at the amplitude of, for example, 50 to 100 Vpp, to the backlighting element 102. Then, light emitting elements within the backlighting element 102 is excited to emit light and illuminate the display unit 101. Electric power consumed by the backlight driver 103 and the backlighting element 102, when those operate, depends on the area of and luminance brightness on the light emitting section of the backlighting element 102. The power consumed is generally 10 to 50 mA for the size of approximately 60 mm×30 mm. After the backlighting element is lit, the backlighting element 102 automatically lights of f under control by the control unit 104 when the following condition is satisfied; viz., the user intentionally lights off the backlighting element or the device is not operated for a predetermined time (several tens seconds to several minutes).

In the conventional backlight device thus constructed, power consumption is large when the backlighting element is lit. When it is applied to the mobile communication devices designed placing emphasis on the portability, such as pagers, portable telephones, PHS terminals, and PDA terminals, reduction of the communication device entails a restriction on the power capacity of the power supply (e.g., a battery). Therefore, the lighting of the backlighting element will greatly influence the battery lifetime. In case where a battery used for such a communication device as an air zinc battery is small in capacity, when the backlighting element is lit to consume large power, the battery voltage will drop. A conventional measure, generally taken for this, is to reduce the power consumption by reducing the luminance brightness of the backlighting element.

Where the EL panel is used, a signal of an AC waveform, e.g., a triangle waveform, needs to be generated for a drive signal during the lighting of the backlighting element, and its power is large. Because of this, the drive signal will cause power source voltage to vary and produce unwanted spurious radiations. Those voltage variation spurious radiations will cause noise and deteriorate radio and acoustic performances of the backlight device. For this reason, additional components are required for noise shielding. Device complication and production cost increase result.

The enhancement of the device function increases the areas that are required for the display section and the operation section of the backlight device, and increases the backlight emitting area. With this, more electric power is consumed for securing a required backlight brightness. Therefore, the power consumption problem is more serious.

SUMMARY OF THE INVENTION

Accordingly, a first object of the present invention is to provide a backlight device and a backlighting element, which effectively suppress power consumption when the backlighting element is lit while keeping luminance brightness at a required level. A second object of the present invention is to provide a backlight device and a backlighting element, which makes the device free from the noise generated when the backlighting element is lit.

Aspect 1 defines a backlight device comprising: a backlighting element for illuminating the back of visually presenting means of a device; and drive control means for intermittently driving the backlighting element at appropriate timings when the backlighting element is lit.

In the backlight device of aspect 1, the drive control means lights on the backlighting element at appropriate timings, for example, at such time intervals as to make the user visually insensitive to flickering of the backlighting element or to make the user visually sensitive to its flicker but to allow the user to decipher characters, for example, on the visually presenting means. The result is reduction of the drive time of the whole device during the backlighting, and reduction of device power consumption.

Aspect 2 defines a backlight device defined comprising: a backlighting element for illuminating the back of visually presenting means of a device; and drive control means for temporarily stopping the driving of the backlighting element when a device portion being adversely affected by noise generated by operation of the backlighting element is operated, in synchronism with operation timings of the device portion.

In the backlight device of aspect 2, the drive control means temporarily stops the driving of the backlighting element when the device portion being adversely affected by noise generated by operation of the backlighting element, for example, the radio processing unit of a communication device, is operated, in synchronism with the device portion. With this, there is no chance that the noise by the backlighting adversely affects the device.

Aspect 3 defines a backlighting element with an EL panel for illuminating the back of visually presenting means of a device, the backlighting element being characterized in that one of the upper and lower electrodes, which form a light emitting section of the backlighting element, is formed so that the light emitting section is disposed occupying a part of an area defined by a configuration of light emitting means in the EL panel.

As defined in aspect 4, the light emitting section takes the form of any of a lattice, a stripe and a slant lattice.

As defined in aspect 5, the visually presenting means illuminated is a liquid crystal panel constituting a display unit of a device, and the light emitting section is divided into a plurality of segments corresponding to display lines of the liquid crystal display panel or display units consisting of display characters.

As defined in aspect 6, the visually presenting means illuminated is a liquid crystal panel constituting a display unit of a device, and the light emitting section includes a plurality of light emitting segments corresponding to display lines of the liquid crystal display panel or display units consisting of display characters, the plurality of light emitting segments being selectively driven.

In the backlighting element defined in aspects 3 to 6, one of the upper and lower electrodes, which form a light emitting section of the backlighting element, is formed so that the light emitting section is disposed occupying a part of an area defined by a configuration of light emitting means in the EL panel. Therefore, the actually light emitting area of the light emitting potion may be reduced. The power consumed when the backlighting element is driven is lessened for a given level of luminance brightness. This leads to reduction of the power consumption during the backlighting.

Aspect 7 defines a backlight device comprising: a backlighting element with an EL panel for illuminating the back of visually presenting means of a device, the backlighting element being constructed in that one of the upper and lower electrodes, which form a light emitting section of the backlighting element, is formed so that the light emitting section is disposed occupying a part of an area defined by a configuration of light emitting means in the EL panel, and light diffusing means for diffusing light emitted from the light emitting section. As defined in aspect 8, the light diffusing means is formed by interposing a sheet or plate like member having a light diffusing function between the backlighting element and an illuminated member, by coating the surface of the backlighting element with light diffusing material, or by coupling an optical member having light diffusing function to the backlighting element or an illuminated member.

In the construction defined in aspects 7 and 8, one of the upper and lower electrodes, which form a light emitting section of the backlighting element, is formed so that the light emitting section is disposed occupying a part of an area defined by a configuration of light emitting means in the EL panel. Therefore, the actually light emitting area of the light emitting potion may be reduced. The power consumption during the backlighting is reduced. A dark and bright pattern of the light emitting section of the backlighting element is diffused, so that uniform illumination is obtained. No unnatural visual feeling is presented to the user.

Aspect 9 further defines the backlight device of any of aspects 1, 2 and 7 such that the backlighting device further comprises a light storage member capable of storing backlight from the light emitting means of the backlighting element or natural light and spontaneously emitting light. As defined in aspect 10, the light storage means is formed by interposing a sheet or plate like member containing light storage material between the backlighting element and an illuminated member, by coating the surface of the backlighting element with light storage material, or by use of the backlighting element containing light storage material.

In the backlight devices of aspects 9 and 10, an illumination effect is secured if the backlighting element is not lit because of use of the light storage member. The on time of the backlighting element is reduced, and the device power consumption is reduced. Further, even when the backlighting element is intermittently lit, the user is insensitive to its flicker.

Aspect 11 further defines the backlighting device of aspect 7 such that the visually presenting means illuminated is a liquid crystal panel constituting a display unit of a device, and the light emitting section is divided into a plurality of segments corresponding to display lines of the liquid crystal display panel or display units consisting of display characters, and the backlighting device further comprising drive control means for selectively driving the plurality of segments of the light emitting section to locally light on and off the light emitting section.

In the backlight device of aspect 11, the light emitting section of the backlighting element is divided into a plurality of light emitting segments. Those segments are selectively lit on and off. Therefore, the backlighting element may be driven only when its drive is required. The power consumption during the backlighting is reduced.

DETAILED DESCRIPTION OF THE PREFERRED EMBODIMENTS

The embodiments of the present invention will be described with reference to the accompanying drawings.

First Embodiment

Backlight Device Constituting an Embodiment of the Present Invention.

Figure 1:
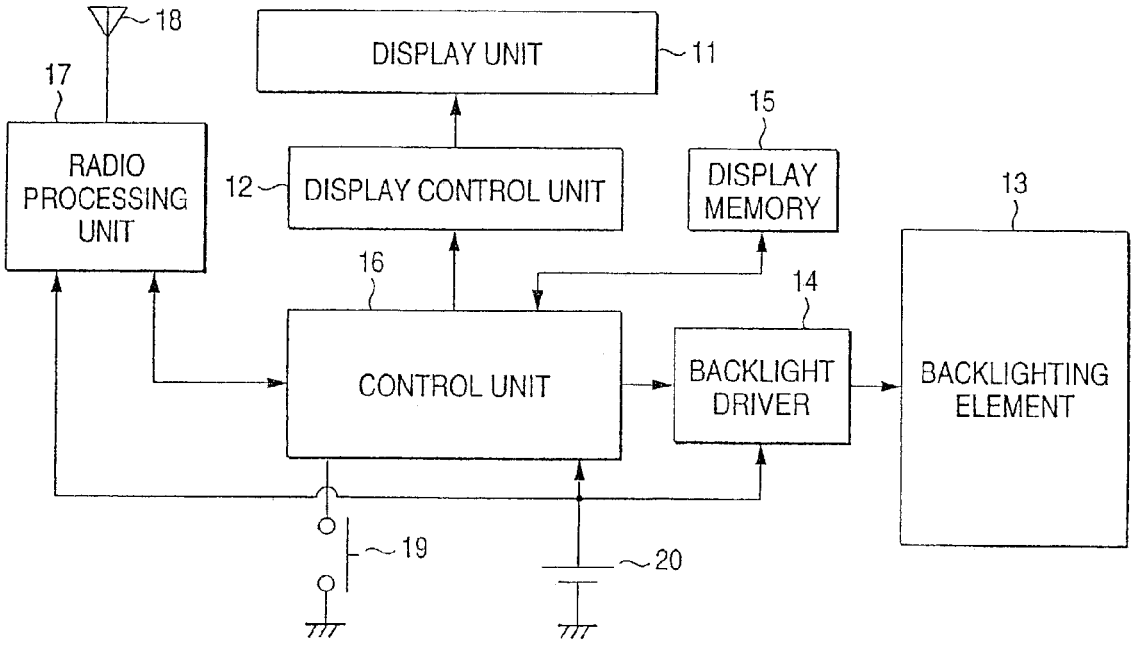
FIG. 1 is an electrical arrangement of a device provided with a backlight device, which is an embodiment of the present invention.
Figure 2:
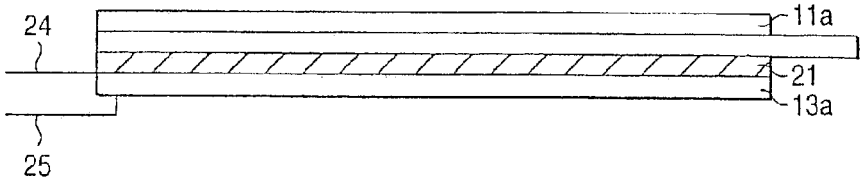
FIG. 2 is a side view showing a structure including a display unit and a backlighting element of the backlight device, which is constructed as a first embodiment of the invention.
Figure 3:
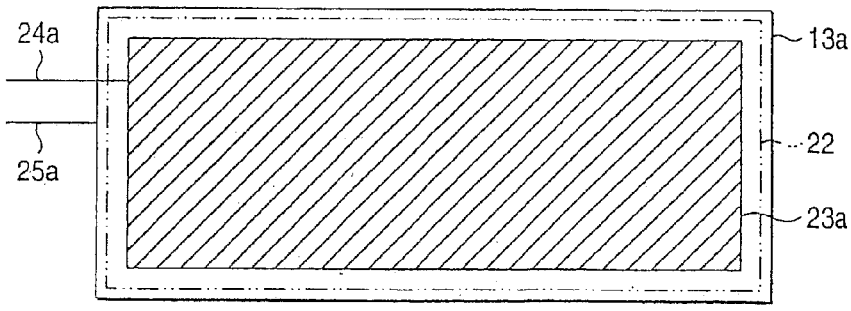
FIG. 3 is a plan view of a structure of a light emitting section of the backlighting element in the first embodiment.

FIG. 1 is an electrical arrangement of a device provided with a backlight device, which is an embodiment of the present invention. FIG. 2 is a side view showing a structure including a display unit and a backlighting element of the backlight device. FIG. 3 is a plan view of a structure of a light emitting section of the backlighting element.

In the embodiment to be described hereunder, the backlight device of the invention is incorporated into such a mobile communication device as a pager. The mobile communication device is made up of a display unit 11, a display control unit 12, a backlighting element 13, a backlight driver 14, a display memory 15, a control unit 16, a radio processing unit 17, and an antenna 18. The display unit 11 includes an LCD for displaying characters and/or images. The display control unit 12 drives and controls the display unit 11. The backlighting element 13 includes an EL (electroluminescence) panel for illuminating the back of the display unit 11. The backlight driver 14 drives and controls the backlighting element 13. The display memory 15 stores display data of characters and/or images to be displayed on the display unit 11. The control unit 16 controls the display unit 11 and the backlight driver 14. The radio processing unit 17 processes radio signals for transmission and reception. The mobile communication device further includes switch means 19 for entering a backlighting instruction and performing various operations, and a power supply 20 for supplying electric power to the whole device. The control unit 16 serves as drive control means, which sends instructions to the backlight driver 14 and controls the drive of the backlighting element 13 in various ways.

The structure including the display unit 11 and backlighting element 13 will be described. As shown in FIG. 2, an LCD panel 11*a* of the transparent or semitransparent type forms the display unit 11. An EL panel 13*a* forms the backlighting element 13. The EL panel 11*a* is disposed on the rear side of the LCD panel 11*a*. Light emitted from the EL panel 13*a* passes through the LCD panel 11*a*, and the EL panel is irradiated from the front broad side thereof. Thus, a structure in which a light is irradiated from the back of the LCD panel 11*a* is employed. Light storage member 21 for storing backlight or natural light is layered between the EL panel 13*a* and the LCD panel 11*a*.

To form the light storage member 21, the surface (referred to as a light emitting surface in an appropriate situation) of the EL panel 13*a* may coated with light storage material. Alternatively, a sheetor plate-like member containing light storage material, such as a PET film or a plastic film, may be layered on the light emitting surface. In a further alternative, light storage material may be contained In sealing resin within the EL panel 13*a* or light emitting material. An example of the light storage material is a metallic compound containing a rare-earth metal element.

As shown in FIG. 3, a light emitting section 23*a* is formed in the EL panel 13*a* such that it entirely covers a viewing region 22 of the LCD panel 11*a*. A configuration of the light emitting section 23*a* is determined by a configuration (a rectangle of the entire viewing region 22 in the instance of FIG. 3) of an upper electrode 24*a* and a lower electrode 24*b*, which are used for applying an electric field to the interior light emitting member. In the EL panel, the light emitting member and the upper and lower electrodes disposed on both sides of the light emitting member form light emitting means.

An operation of the device provided with the backlight device thus constructed will be described. In a reception mode, the antenna 18 receives a radio signal, and the radio processing unit 17 appropriately processes the radio signal from the antenna under control and reproduces communication information under control by the control unit 16. It sends a proper instruction to the display control unit 12, and causes the same to display characters and/or images. At this time, the control unit 16 develops display data based on the communication information into the display memory 15, and transfers the display data to the display control unit 12. The display control unit 12 drives the display unit 11 in accordance with the display data and causes it to display characters and/or images on the display surface of the display unit 11. The visual representation of the reproduced signal, viz., displaying of characters, for example, may be replaced with an acoustic representation, for example, driving of a buzzer or speaker to generate a sound or a dynamic representation as driving of a vibrator to vibrate by operating its motor.

When the display unit 11 is driven in a dark place, the backlighting element 13 is lit to secure a satisfactory viewing. In this case, when the switch means 19 is depressed, the control unit 16 sends an instruction to the backlight driver 14 to operate the same. A drive signal that at this time the backlight driver 14 applies to the backlighting element 13 is a signal of an AC waveform (e.g., a sinusoidal, triangle or rectangular waveform) at the amplitude of 50 to 100 Vp-p. By the drive signal, the light emitting member within the backlighting element 13 is excited to emit light and illuminate the display unit 11.

In the embodiment, the light storage member 21 is provided on the light emitting surface of the backlighting element 13 or in its vicinity. Therefore, a light emitting state of the backlighting element may he maintained without always lighting the backlighting element 13. The light storage member 21 absorbs light from the backlighting element 13 or natural light, and spontaneously emits light to illuminate the display unit 11. Where the light storage member 21, which is capable of absorbing natural light for daytime and spontaneously emitting light for five hours, is used, an effective illumination effects is secured. Therefore, in this case, there is no need of lighting off the backlighting element 13. The fact accrues to reduction of a time of driving the backlight device per se, and consumption of electric power supplied from the power supply 20.

The control unit 16 intermittently drives the backlighting element 13 at proper time intervals (of 1 second, for example) and interrupts the same in a similar manner. The preferable time interval is such that it makes the user visually insensitive to flickering of the backlighting element 13 or it makes the user visually sensitive to its flicker but allows the user to decipher characters, for example, on the display unit 11. Where the light storage function of the backlighting element 13 is utilized, there is no need of always lighting the backlighting element. An operation time of the backlighting function may be selected in accordance with the light storing capacity of the light storage member 21.

Actually, the backlighting element 13 flickers at proper time intervals. However, the user does not recognize the flicker, viz., the user perceives that the backlighting element 13 continuously emits light, since light emitted from the light emitted from the backlighting element 13 is stored in the light storage member 21 and the light storage member 21 spontaneously emits light.

The display memory 15 and the backlighting element 13 do not consume electric power when those are interrupted. Therefore, the consumption of electric power supplied from the power supply 20 may be reduced to approximately ½ in a manner that the power supplying and interruption are alternately repeated at appropriate time intervals by use of the display control unit. Therefore, the drive time of the whole device during the lighting of the backlighting element is reduced. Power consumed by the device provided with the backlight in a standard use condition is reduced.

The radio processing unit 17 processes the wirelessly received signal under control by the control unit 16 (the operation timings of the radio processing unit are controlled by the control unit). Precisely, the radio processing unit performs the processing of the received signal for two seconds every 30 seconds. The radio processing unit 17 receives electric power from the power supply 20 which also supplies electric power to the display memory 15. Therefore, it receives through the power line noise generated when the backlighting element is driven. When the backlighting element 13 is driven, a magnetic field present therearound varies, and the variation of the magnetic field frequently enters as noise in the antenna 18. The control unit 16 stops the operation of the backlight driver 14 when the radio processing unit 17 is operating in synchronism with the device portion, and stops the driving of the backlighting element 13 to light off the same.

For this reason, the radio processing unit 17 is not influenced by noise generated by the backlight. The power consumption by the device is reduced. Further, there is no case that the noise arising from the lighting of the backlighting element adversely affects the device. In connection with this, it is noted that the light storage member 21 is provided on the light emitting surface of the backlighting element 13 or in its vicinity in the embodiment. With the light storage effect of the light storage member 21, when the backlighting element is lit off, the user feels as if it is lit on even when the backlighting element is lit off.

The EL panel is used for the backlighting element 13 in the embodiment. The backlighting element may be constructed by use of LEDs or lamps, for example, instead of the EL panel.

Second Embodiment

A second embodiment of the present invention will be described. The second embodiment corresponds to the first embodiment modified such that the light emitting section of the backlighting element in the first embodiment is modified in the second embodiment.

Figure 9:
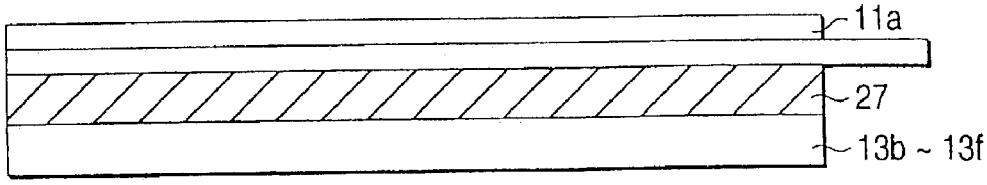
FIG. 9 is a side view showing a structure including a display unit and a backlighting element in the second embodiment.
Figure 10:
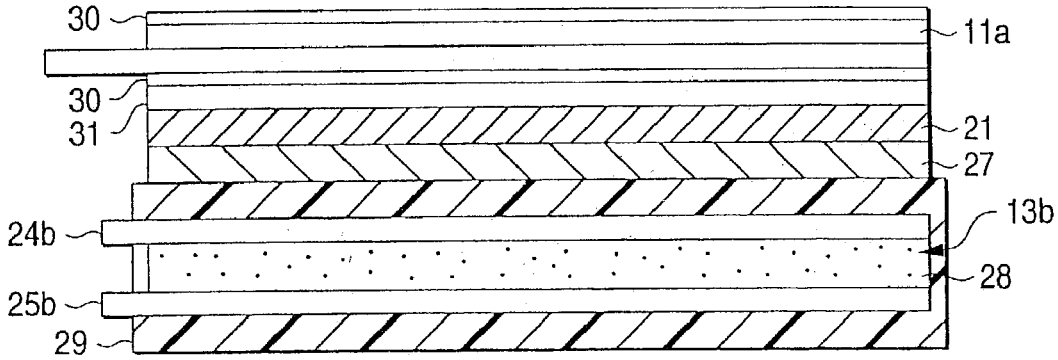
FIG. 10 is a cross sectional view showing the detail of the display unit and the backlighting element in the second embodiment.

FIGS. 4 through 8 show plan views showing some structures of the light emitting section of the backlighting element. FIG. 9 is a side view showing a structure including a display unit and a backlighting element of the backlight device. FIG. 10 is a cross sectional view showing the detail of the display unit and the backlighting element.

Figure 4:
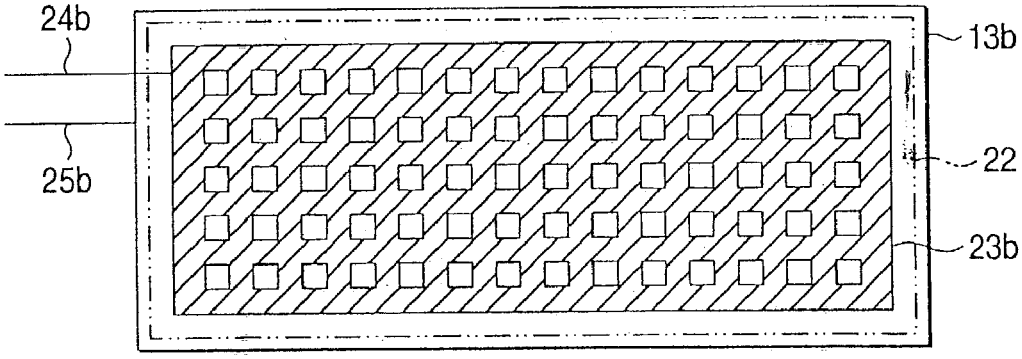
FIG. 4 is a plan view showing a structure (first structure) of a light emitting section of a backlighting element which is a second embodiment of the invention.

A first instance of the light emitting section of the backlighting element is illustrated in FIG. 4. As shown, in the EL panel 13*b* forming the backlighting element 13, a lattice-like light emitting section 23*b* occupies a part of the viewing region 22 of the LCD panel 11*a*. In the light emitting section 23*b*, an upper electrode 24*b* and/or a lower electrode 25*b*, which are for applying an electric field to the light emitting member in the light emitting section, is formed with a lattice-like member.

Figure 5:
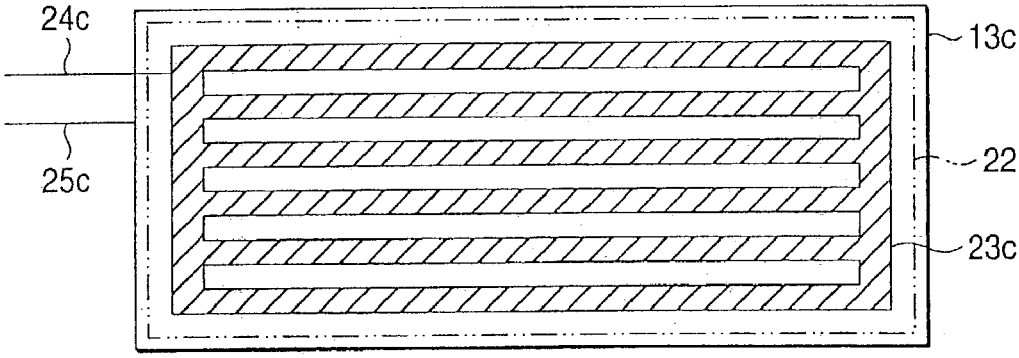
FIG. 5 is a plan view showing a structure (second structure) of a light emitting section of a backlighting element according to the second embodiment of the invention.

A second instance of the light emitting section is illustrated in FIG. 5. In the EL panel 13*c* of the backlighting element 13, as shown, a stripe-like light emitting section 23*c* occupies a part of the viewing region 22 of the LCD panel 11*a*. In the light emitting section 23*c*, an upper electrode 24*b* band/or a lower electrode 25*b* is formed with a stripe-like member.

Figure 6:
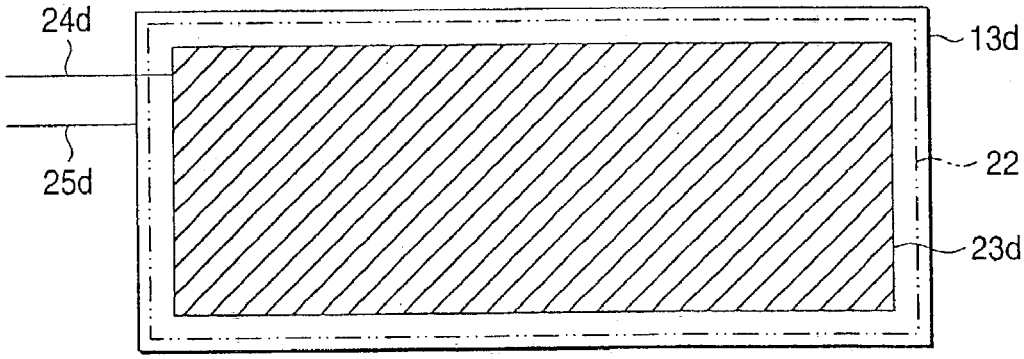
FIG. 6 is a plan view showing a structure (third structure) of a light emitting section of a backlighting element which is a second embodiment of the invention.

A third instance of the light emitting section is illustrated in FIG. 6. As shown, in the EL panel 13*d* of the backlighting element 13, an obliquely arranged lattice-like light emitting section 23*d* occupies a part of the viewing region 22 of the LCD panel 11*a*. In the light emitting section 23*d*, an upper electrode 24*b* and/or a lower electrode 25*b* is formed with a slant-lattice-like member.

Figure 7:
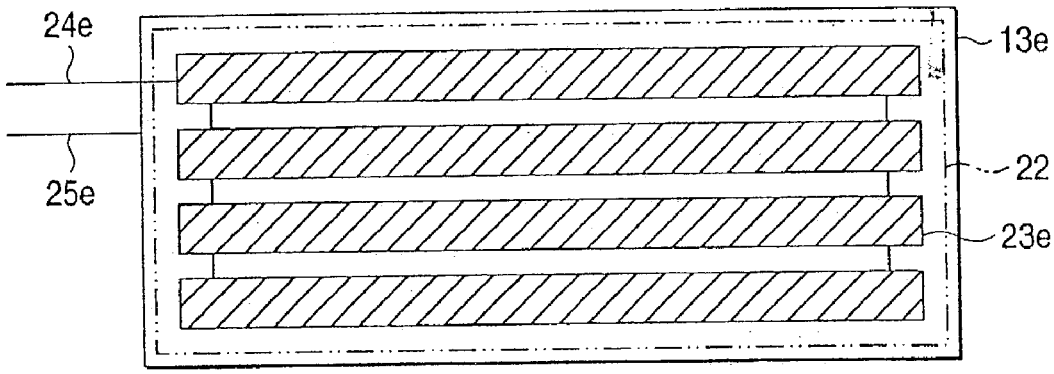
FIG. 7 is a plan view showing a structure (fourth structure) of a light emitting section of a backlighting element according to the second embodiment of the invention.

A fourth instance of the light emitting section is illustrated in FIG. 7. In the EL panel 13*e* of the backlighting element 13, as shown, a light emitting section 23*e* is formed only in the display line regions for displaying lines of characters. In the light emitting section 23*e*, an upper electrode 24*b* and/or a lower electrode 25*b* is formed with rectangular regions (corresponding to display lines), each representing a display unit, being arrayed superposing one rectangular region on the other.

Figure 8:
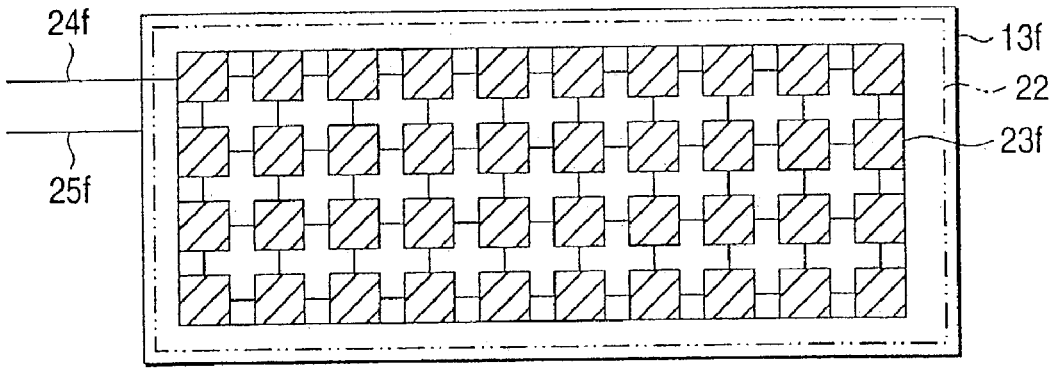
FIG. 8 is a plan view showing a structure (fifth structure) of a light emitting section of a backlighting element according to the second embodiment of the invention.

A fifth instance of the light emitting section is illustrated in FIG. 8. In the EL panel 13*f* of the backlighting element 13, as shown, a light emitting section 23*f* is formed only in the character display regions for displaying characters (symbols and graphics). In the light emitting section 23*f*, an upper electrode 24*b* and/or a lower electrode 25*b* is formed with square or rectangular regions corresponding to character configurations as display units.

It is noted that in the EL panels 13*b* to 13*f*, the light emitting area (area of each of the light emitting sections 23*b* to 23*f*) formed when the panel is driven is smaller than the area defined by the configuration of the whole light emitting surface. As generally known, the power consumption of the device when it is driven depends on the light emitting area.

When the area of the light emitting section is selected to be ½ as large as the whole area of the light emitting surface, the power consumption is also halved. This technical feature of the embodiment lessens the electric power consumed for producing a degree of luminance brightness during the operation of the backlighting element, when comparing with that by the conventional one. Therefore, the backlighting device of the invention can save electric power while keeping the luminance brightness at a predetermined level.

The reduction of the area of the light emitting section may be achieved by modifying the disposition and configuration of the light emitting member located between the upper and lower electrodes, while it is achieved by reducing the areas of the upper and lower electrodes in the above-mentioned embodiment. Further, the light emitting section may take any configuration if the light emitting area is smaller than the area defined by the configuration of the light emitting surface.

FIG. 9 shows a structure including a display unit and a backlighting element when a backlight portion of an LCD panel is formed by use of an EL panel where the light emitting area is smaller than the area defined by the configuration of the light emitting surface. EL panels 13*b* to 13*f* forming the backlighting element 13 are disposed on the back side of an LCD panel 11*a* of the transparent or semitransparent type forms the display unit 11. A light diffusion member 27 is interposed between those EL panels and the LCD panel. The light diffusion member 27 constitutes light diffusing means for diffusion light emitted from the backlighting element. With provision of the light diffusion member 27, light emitted from the EL panels 13*b* to 13*f* is diffused to be uniform in distribution and uniformly illuminates the LCD panel 11*a*. Therefore, there is no chance that the light emitting surfaces of the EL panels 13*b* to 13*f* are viewed as a bright and dark pattern (lattice or stripe pattern) like a pattern of the light emitting section, through the LCD panel 11*a*. In other words, uniform backlight is produced.

FIG. 10 shows in more detail the structure including the display unit and the backlighting element. In the EL panel 13*b*, a light emitting member 28 is interposed between the upper and lower electrodes 24*b* and 25*b*. The upper electrode 24*b* is a transparent electrode made of, for example, $In_2O_3$: Sn (ITO). The lower electrode 25*b* is formed with an aluminum electrode. The light emitting member 28 is made of ZnS: Mn, for example. The multilayered panel formed with that electrode and the member is covered with a sealing resin 29 formed with a PET film, whereby the outer surface of the multilayered panel blocks the entering of humidity into the inside material thereof. In operation, a drive signal of an AC waveform is applied from the backlight driver 14 (FIG. 1) to between the upper and lower electrodes 24*b* and 25*b*. In turn, the light emitting member 28 is excited to produce illumination light.

The light diffusion member 27 and the light storage member 21 are layered on the side of the upper electrode 24 (light emitting surface) f the EL panel 13*b*. The LCD panel 11*a* is sandwiched with polarizing plates 30. When the panel 11*a* is of the semitransparent type, a semitransparent reflecting plate 31 is located on the back side of the LCD panel. The light diffusion member 27 takes the form of a sheet or plate in the structure of FIG. 10. If required, it may be integral with the sealing resin 29 in the EL panel 13*b*; it may be coated on the light emitting surface of the EL panel 13*a*; or it may be integral with the semitransparent reflecting plate 31 in the LCD panel 11*a* as an illuminated member.

The EL panel thus structured accrues to the following advantages. The power consumption by the device can be reduced in a manner that the lighting time of the backlighting element and the light emitting area are reduced. Problems of flashing and dimming or pattern are solved. Therefore, uniform light is presented to the user's eyes. The backlighting element gives rise to no unnatural visual feeling by the user.

Third Embodiment

Figure 11:
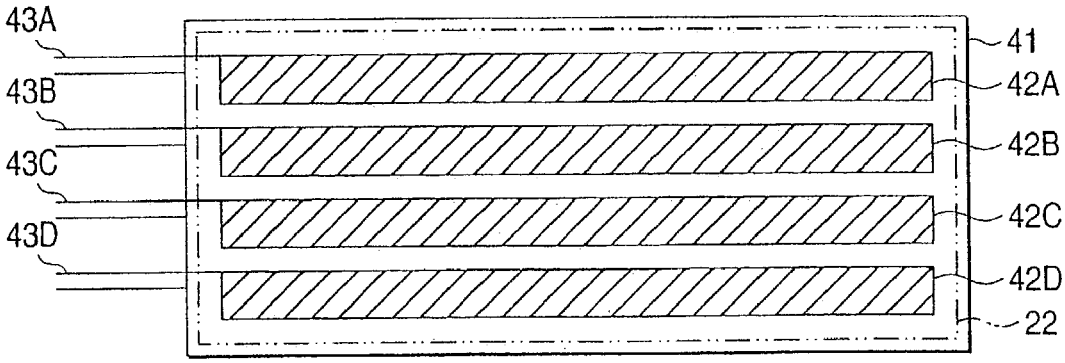
FIG. 11 shows a plan view of a structure of a light emitting section of a backlighting element which is a third embodiment of the present invention.
Figure 12:
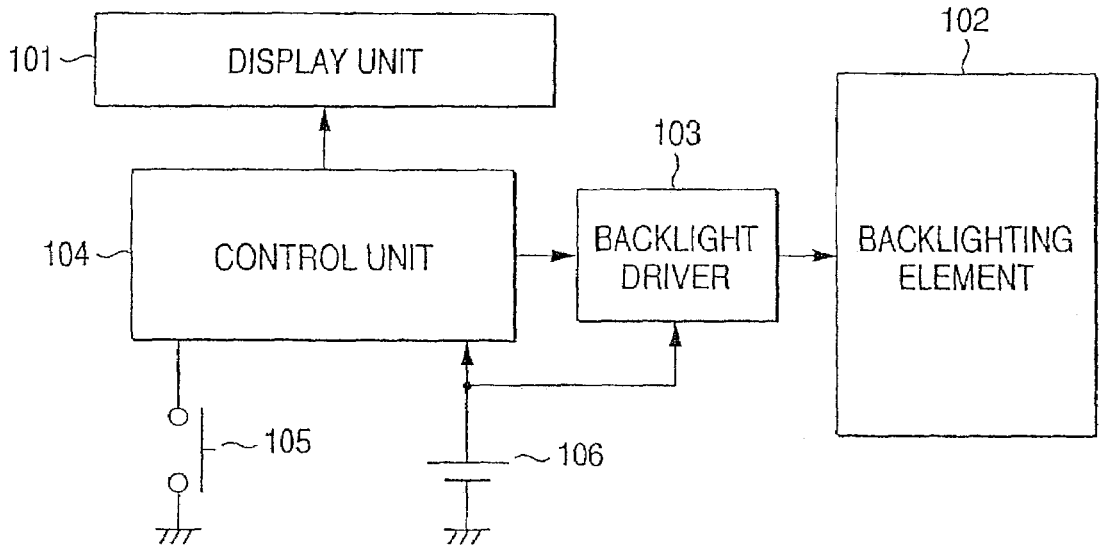
FIG. 12 is a block diagram showing an electrical arrangement of a device with a conventional backlight device.
Figure 13:
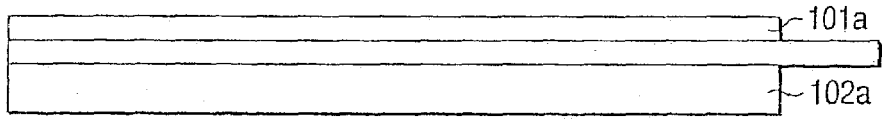
PRIOR ART FIG. 13
FIG. 13 shows a side view of a conventional structure including a display unit and a backlighting element.
Figure 14:
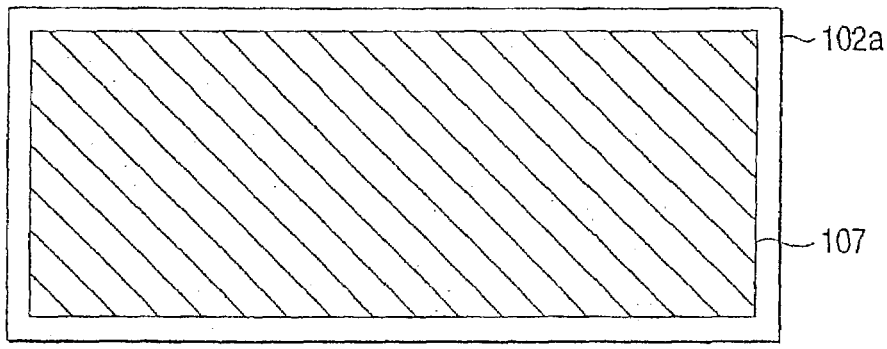
PRIOR ART FIG. 14
FIG. 14 shows a plan view of the conventional backlighting element.

FIG. 11 shows a plan view of a structure of a light emitting section of a backlighting element which is a third embodiment of the present invention. The third embodiment is arranged such that the light emitting section of the backlighting element consists of a plurality of light emitting segments, and those segments are selectively driven.

As shown, an EL panel 41 forming the backlighting element 13 includes light emitting segments 42A to 42D located for the display region 22 of the LCD panel 11*a* and electrodes 43A to 43D respectively associated with those elements 42A to 42D. The light emitting segments 42A to 42D are located for each display line as a display unit.

When the EL panel 41 is used for backlighting the LCD panel 11*a*, the light emitting segments 42A t 42D are selectively driven by the control unit 16 in the FIG. 1 circuit. When characters of only one line (corresponding to the region of the light emitting segment 42A) are displayed in the viewing region 22 of the LCD panel 11*a*, the control unit causes the backlight driver 14 to send a drive signal to the electrode 43A, and locally light on only the light emitting segment 42A.

In this case, the control unit 16 develops display data to be displayed by the display unit 11 on the display memory 15. It sequentially transfers the display data to the display control unit 12 (for example, every byte), and causes the display unit 11 to display characters and/or images under control of the display control unit. Information for the display location, based on the display data, is transferred to the backlight driver 14. Thus, the control unit judges a location where characters are currently displayed, and locally lights on and off the light emitting section. In order to light on only the light emitting segment corresponding to the display location in the display unit 11, the backlight driver 14 specifies one of the electrodes 43A to 43D, and sends a drive signal to the specified one. In this way, the backlight driver 14 partially drives the EL panel 41.

As described above, the third embodiment is arranged such that the light emitting section of the EL panel consists of a plurality of light emitting segments, and those segments are selectively driven. With this arrangement, when only the first display line is displayed, the light emitting segment 42A of those four ones is lit. This fact indicates that the power consumption is reduced to about ¼ of the power which otherwise is consumed. Therefore, the third embodiment can save electric power when the backlighting element is lit, as the first and second embodiments so do.

The third embodiment may be modified such that the upper electrode and the lower electrode of the EL panel are disposed at a right angle. In the modification can locally light the light emitting section every character, not display line, in a manner that two drive signals, horizontal and vertical drive signals, are applied at appropriately controlled timings.

In the above-described embodiments, the backlighting element constructed according to the present invention is applied to the LCD panel. It is readily understood that the backlighting element of the invention may be applied to the backlighting visually presenting means in the display section or the operation section of any of other devices.

As described above, the backlight device of the invention reduces the power consumption when the backlighting element is lit on. Further, it reduces electric power supplied from the power supply, and prevents temporary large current consumption. The present invention is preferably applied to a device of which the power supply is a battery, viz., the device in which the battery capacity and current feeding ability are restricted. When applied, the lifetime of the battery will be increased. Such a device may be a mobile communication device. The device portion sensitive to the noise caused when the backlighting element is lit on, such as the radio processing unit, may be protected against the noise by lighting off the backlighting element when the device portion operates. Further, the invention succeeds in solving the problems due to the lighting of the backlighting element, such as run-down of the battery during the operation of the device, increase of power consumption, and noise interference.

As seen from the foregoing description, the backlight device constructed according to the present invention intermittently lights the backlight element at proper timings under control by the drive control means. Therefore, the backlight device can suppress the power consumption when it is operating while keeping luminance brightness at a required level.

Further, the backlight device can solve such a problem that the device is adversely affected by the noise generated when the backlighting element is lit. To this end, the backlighting element is temporarily stopped in operation when the noise receiving portion of the device is operating in synchronism with the operation timings of the noise receiving portion.

One of the upper and lower electrodes, which form a light emitting section of a backlighting element with an EL panel, is formed so that the light emitting section is disposed occupying a part of an area defined by a configuration of light emitting means. Therefore, an actually light emitting area of the light emitting section can be reduced. This technical feature lessens the electric power consumed for producing a degree of luminance brightness during the operation of the backlighting element, when comparing with that by the conventional one. Therefore, the backlighting device of the invention reduces the power consumption during the operation of the backlighting element. The backlight device of the invention may include light diffusing means for diffusing light emitted from the light emitting section. With provision of the light diffusion means, uniform light is presented to the user's eyes, and no unnatural visual feeling is presented to the user.

The backlight device may include light storage member that stores light from light emitting means of the backlighting element or natural light, and spontaneously emits light. With this, the lighting time of the backlighting element is reduced. The power consumption by the device is reduced. Further, use of the light storage member makes the user insensitive to flicker even if the backlighting element is intermittently driven.

Further, the light emitting section of the backlighting element consists of a plurality of light emitting segments. Those segments are selectively lit on and off. This feature reduces the power consumption of the device during the operation of the backlighting element.

What is claimed is:

1. A backlight device comprising:

a backlighting element for illuminating the back of visually presenting means of a device; and drive control means for temporarily stopping the driving of said backlighting element when a portion of said device is being adversely affected by noise generated by operation of said backlighting element, wherein said drive control means is operated in synchronism with operation timings of the device.

2. The backlight device according to claim 1, further comprising: a light storage member capable of storing backlight from said light emitting means of said backlighting element or natural light to spontaneously emit light.

3. A mobile communication device comprising a backlight device, the backlight device comprising:

a backlighting element with an EL panel providing a light emitting means for illuminating the back of a visually presenting means;

at least one light emitting section making up the backlighting element; and upper and lower electrodes forming each of said light emitting sections; wherein at least one of said upper and lower electrodes form the light emitting section of said backlighting element such that said light emitting section is disposed to occupy a portion that is less than a whole part of a viewing area of said backlighting element defined by a configuration of said light emitting means in said EL panel, and wherein said light emitting section is further disposed such that another portion that is less than a whole part of the viewing area is not occupied by any light emitting section, and further wherein said backlight device is adapted such that when the light emitting means is illuminating said back, a viewer is given the impression that said another portion is also being illuminated.

4. The mobile communication device according to claim 3, wherein said light emitting section takes a form selected from a group of a lattice, a stripe and a slant lattice.

5. The mobile communication device according to claim 3, wherein said visually presenting means comprises a display unit including a liquid crystal panel and wherein said light emitting section is formed corresponding to a shape of display lines of said liquid crystal display panel or display units consisting of display characters.

6. The mobile communication device according to claim 3, wherein said visually presenting means comprises a display unit including a liquid crystal panel and wherein said light emitting section is divided into a plurality of light emitting segments corresponding to display lines of said liquid crystal display panel or display units consisting of display characters, and further wherein said plurality of light emitting segments are selectively driven.

7. The mobile communication device according to claim 3 further comprising:

a light diffusing means for diffusing light emitted from said light emitting section.

8. The mobile communication device according to claim 7, wherein said light diffusing means is formed by interposing a sheet or plate member having a light diffusing function between said backlighting element and an illuminated member, by coating the surface of said backlighting element with light diffusing material, or by coupling an optional member having light diffusing function to said backlighting element or an illuminated member.

9. The mobile communication device according to claim 7, further comprising: a light storage member capable of storing backlight from said light emitting means of said backlighting element or natural light to spontaneously emit light.

10. The mobile communication device according to claim 9, wherein said light storage means is formed by interposing a sheet or plate member with light storage material between said backlighting element and an illuminated member, by coating the surface of said backlighting element with light storage material, or by use of said backlighting element with light storage material.

11. The mobile communication according to claim 7, wherein:

said visually presenting means is a liquid crystal panel constituting a display unit of a device, said light emitting section of said backlighting element is divided into a plurality of segments corresponding to display lines of said liquid crystal display panel or display units consisting of display characters, and said backlighting device comprises drive control means for selectively driving said plurality of segments of said light emitting section to locally light on and off said light emitting section.

* * * * *

UNITED STATES PATENT AND TRADEMARK OFFICE

CERTIFICATE OF CORRECTION

PATENT NO. : 7,038,391 B2
APPLICATION NO. : 10/464218
DATED : May 2, 2006
INVENTOR(S) : Toshiyuki Tsumura It is certified that error appears in the above-identified patent and that said Letters Patent is hereby corrected as shown below:

Column 2, line 11: Please delete "of f" and insert the word --off--;

Column 12, line 52: After the word "panel", please insert --,--;
Column 14, line 1: After the word "communication", please insert the word --device--

Signed and Sealed this

Nineteenth Day of June, 2007

JON W. DUDAS
*Director of the United States Patent and Trademark Office*